US006715605B1

(12) United States Patent
Manservigi et al.

(10) Patent No.: US 6,715,605 B1
(45) Date of Patent: Apr. 6, 2004

(54) RIGID HINGED-LID CIGARETTE PACKET

(75) Inventors: Alberto Manservigi, Bologna (IT); Claudia Piazzi, Bologna (IT); Fiorenzo Draghetti, Medicina (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 10/069,859

(22) PCT Filed: Aug. 31, 2000

(86) PCT No.: PCT/IT00/00349

§ 371 (c)(1),
(2), (4) Date: Dec. 11, 2002

(87) PCT Pub. No.: WO01/15999

PCT Pub. Date: Mar. 8, 2001

(30) Foreign Application Priority Data

Sep. 1, 1999 (IT) ..... BO99A0469

(51) Int. Cl.[7] ..... B65D 85/10
(52) U.S. Cl. ..... 206/268; 229/160.1
(58) Field of Search ..... 206/242, 265, 206/268, 271, 273; 229/160.1

(56) References Cited

U.S. PATENT DOCUMENTS

| | | | | |
|---|---|---|---|---|
| 4,753,384 A | | 6/1988 | Focke et al. | |
| 5,143,282 A | * | 9/1992 | Pham | 229/160.1 |
| 5,957,280 A | | 9/1999 | Focke et al. | |

FOREIGN PATENT DOCUMENTS

| | | |
|---|---|---|
| DE | 29 40 421 | 4/1981 |
| DE | 36 27 440 | 2/1988 |
| DE | 196 37 259 | 3/1998 |

* cited by examiner

*Primary Examiner*—Jim Foster
(74) *Attorney, Agent, or Firm*—Marshall, Gerstein & Borun LLP

(57) ABSTRACT

A rigid, substantially parallelepiped-shaped packet (1) for cigarettes (3) bas a lateral surface (8) defined by two flat, parallel, facing minor lateral walls (11), and by two facing major lateral walls (12), each of which has an outwardly convex profile, is connected to both the minor lateral walls (11) along sharp edges (13), and forms, with the two minor lateral walls (11), respective obtuse dihedral angles (14); the packet (1) also has a top lid (6) hinged to a bottom cup-shaped container (4) by a hinge (7) parallel to the minor lateral walls (11).

14 Claims, 6 Drawing Sheets

RIGID HINGED-LID CIGARETTE PACKET

TECHNICAL FIELD

The present invention relates to a rigid hinged-lid cigarette packet.

In particular, the present invention relates to a rigid cigarette packet comprising a cup-shaped bottom portion or container and a top lid joined to each other by a hinge, and which is formed from a preweakened flat blank of cardboard or similar.

BACKGROUND ART

Rigid hinged-lid cigarette packets are normally in the shape of a rectangular-section parallelepiped, and comprise two major lateral walls—defined by a front wall and a rear wall—and two minor lateral walls, each connected to both the major lateral walls at respective sharp right-angle longitudinal edges.

Rigid packets of the above type have several drawbacks, by being nonanatomical in shape and resulting in rapid wear of clothing fabrics with which they come into contact.

Moreover, rigid, rectangular-section, parallelepiped-shaped packets are fairly rigid at the minor lateral walls and along the right-angle longitudinal edges, but fairly weak at the major lateral walls, which have a tendency to deform inwards when a transparent overwrapping of cellophane is applied and shrunk (by the application of heat) about the packet.

Inward deformation of the major lateral walls, produced by the inward thrust exerted on the packet by the transparent overwrapping, permanently compresses the cigarettes inside the packet, making it very difficult for the user to extract the first cigarette from the packet. Moreover, deformation of the major lateral walls, and in particular the rear one, deforms the hinge joining the lid to the bottom portion, so that, when the transparent overwrapping is opened (normally torn open), the lid can only be raised easily by the user taking the whole overwrapping off the packet.

The above drawbacks are at least partly solved by rounded- or beveled-edged packets of the type described in patents EP-B1-0204933 and EP-B1-0205766 respectively. Rounded- or beveled-edged packets are also described in DE-A1-19637259, which relates to a hard packet for cigarettes having a hinged lid extending on one side and being diagonally off-center; this lid forms in the region of an end wall of the packet a line joint as a hinged connection to join the hinged lid to the remaining portion of the packet.

Generally speaking, however, both rounded- or beveled-edged packets, to be manufactured fairly accurately, call for special machines of the type described in patents EP-B1-0205894 and EP-B1-0200087, which are fairly slow and allow of absolutely no flexibility, i.e. cannot be used for producing packets other than the types mentioned.

As a result, rounded- or beveled-edged packets are extremely expensive to produce.

Besides being expensive to produce, rounded-edged packets also have a further drawback: that of the lid failing to accurately close the bottom cup-shaped container, on account of the difficulty posed in forming two coincident rounded edges. Moreover, at the rounded edges of the top and bottom walls, the transparent overwrapping sheet of cellophane, as opposed to following the outer shape of the packet, forms sharp edges which are particularly rigid and project outwards of the packet, and, besides being unsightly, result in rapid wear of clothing fabrics with which they come into contact.

DISCLOSURE OF INVENTION

It is an object of the present invention to provide a rigid, hinged-lid cigarette packet designed to eliminate the aforementioned drawbacks.

More specifically, it is an object of the present invention to provide a rigid, hinged-lid cigarette packet, which:

- at the overwrapping stage, does not compress the group of cigarettes inside, thus enabling troublefree extraction of the first cigarette when the packet is opened;
- comprises a hinge so located as to be substantially undeformable by application of the transparent overwrapping;
- does not result in rapid wear of clothing fabrics with which the packet comes into contact; and
- can be produced easily, cheaply and quickly on, and with only minor alterations to, a packing machine substantially of the type used to produce rectangular-section parallelepiped-shaped packets.

According to the present invention, there is provided a rigid, hinged-lid cigarette packet as recited by claim 1.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
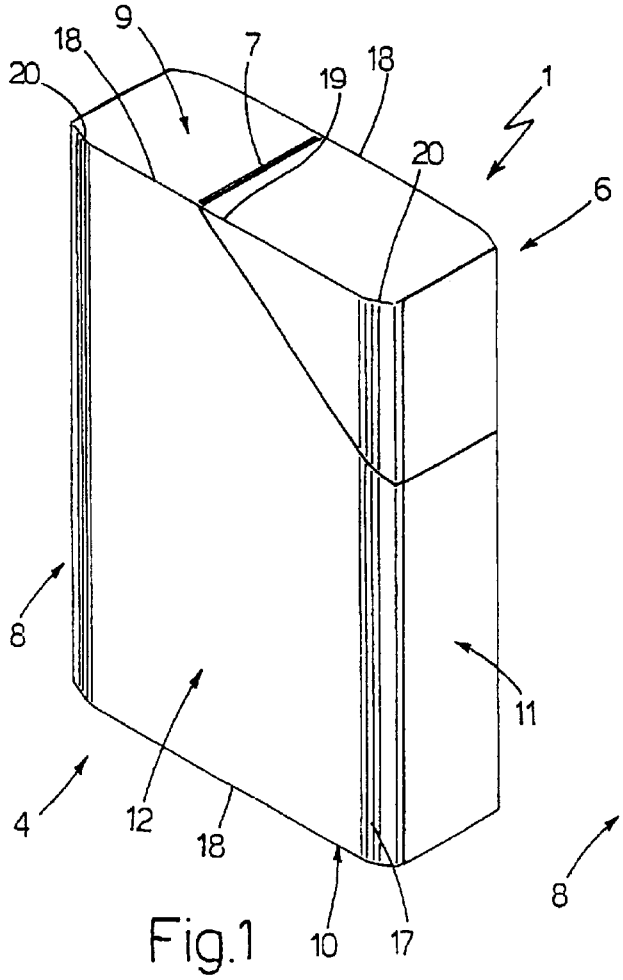
FIG. 1 shows a front view in perspective of a preferred embodiment of the packet according to the present invention in the closed configuration.
Figure 2:
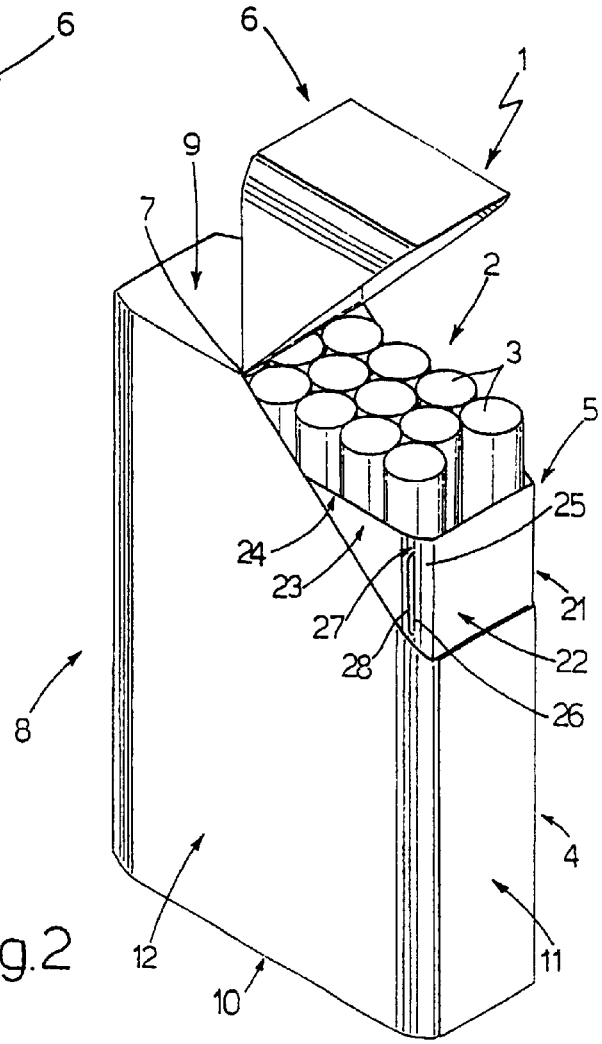
FIG. 2 shows a view in perspective of the FIG. 1 packet in the open configuration.
Figure 3:
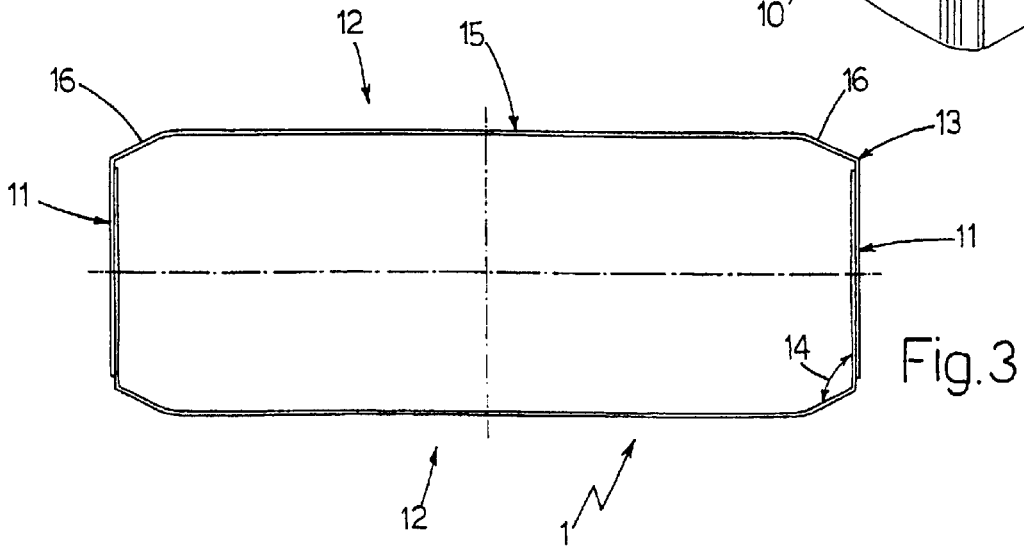
FIG. 3 shows a cross section, with parts removed for clarity, of the FIG. 1 packet.

Number 1 in FIGS. 1, 2 and 3 indicates as a whole a packet housing a group 2 of cigarettes 3 arranged in three layers, the intermediate layer of which has one cigarette 3 fewer than the two outer layers.

Packet 1 comprises a cup-shaped bottom container 4 having an open top end 5; and a cup-shaped top lid 6 hinged to container 4 along a hinge 7 to rotate, with respect to container 4, between an open position (FIG. 2) and a closed position (FIG. 1) closing end 5.

When lid 6 is closed, packet 1 is in the form of a substantially rectangular parallelepiped defined by a lateral surface 8, and by a top and bottom end wall 9 and 10, which are flat and identical, are positioned facing and parallel to each other, and define lateral surface 8.

Lateral surface 8 comprises two facing flat parallel minor lateral walls 11, and two facing major lateral walls 12; and each major lateral wall 12 has an outwardly convex profile, is connected to the two minor lateral walls 11 along respective sharp edges 13 perpendicular to end walls 9 and 10, and forms respective substantially obtuse dihedral angles 14 with the two minor lateral walls 11.

Each major lateral wall 12 comprises a substantially rectangular, flat central portion 15; and two lateral bands 16 located on either side of central portion 15, and between portion 15 and respective edges 13. Each lateral band 16 is preweakened internally by longitudinal weakening lines 17, so as to curve outwards, connect central portion 15 to respective minor lateral wall 11, and form, with minor lateral wall 11, respective sharp edge 13 and respective obtuse dihedral angle 14.

Each end wall 9, 10 has two major lateral edges 18, each of which defines a respective major lateral wall 12 and comprises a substantially straight central portion 19 corresponding to central portion 15 of major lateral wall 12, and two curved lateral portions 20 corresponding to lateral bands 16 of major lateral wall 12 (and therefore of the same shape as each of respective lateral bands 16 in cross section).

As shown clearly in FIG. 3, the distance between central portions 15 of major lateral walls 12 is therefore greater than the distance between edges 13 of major lateral walls 12.

In a further embodiment not shown, only one major lateral wall 12 has an outwardly convex profile and forms respective substantially obtuse dihedral angles 14 with the two minor lateral walls 11, while the other major lateral wall 12 is flat and forms right angles with the two minor lateral walls 11.

In a further embodiment not shown, major lateral walls 12 are flat, and each minor lateral wall 11 has an outwardly convex profile and forms respective substantially obtuse dihedral angles with the two major lateral walls 12.

As shown in FIGS. 1 and 2, hinge 7 of lid 6 is located on top end wall 9, and is perpendicular to central portions 15 of major lateral walls 12 and parallel to minor lateral walls 11. Lid 6 affects a lateral portion of a top portion of packet 1, and comprises a portion of top end wall 9, a top portion of a minor lateral wall 11, and two substantially triangular portions of major lateral walls 12.

Packet 1 also comprises a collar 21 which, folded into a U, is connected (glued) to the inside of cup-shaped container 4, so as to project partly outwards of end 5 and engage a corresponding inner surface of lid 6 in said closed position (shown in FIG. 1). Collar 21 comprises a front wall 22 parallel and connected to the inner surface of a respective minor lateral wall 11; and two lateral walls 23, each parallel and connected to the inner surface of a respective major lateral wall 12. More specifically, each lateral wall 23 of collar 21 comprises a flat portion 24 connected to the inner surface of flat central portion 15 of respective major lateral wall 12; and a curved portion 25 which is the same shape as and extends in contact with the inner surface of lateral band 16 of respective major lateral wall 12 to connect portion 24 to wall 22.

Each curved portion 25 is preweakened internally by longitudinal weakening lines 26, identical with longitudinal weakening lines 17 of lateral bands 16, so as to curve outwards like lateral bands 16; and each curved portion 25 has a longitudinal slit 27 defining in known manner a brake tab 28, which cooperates with an inner surface of lid 6 to keep lid 6 in the closed position with a given force.

Figure 10:
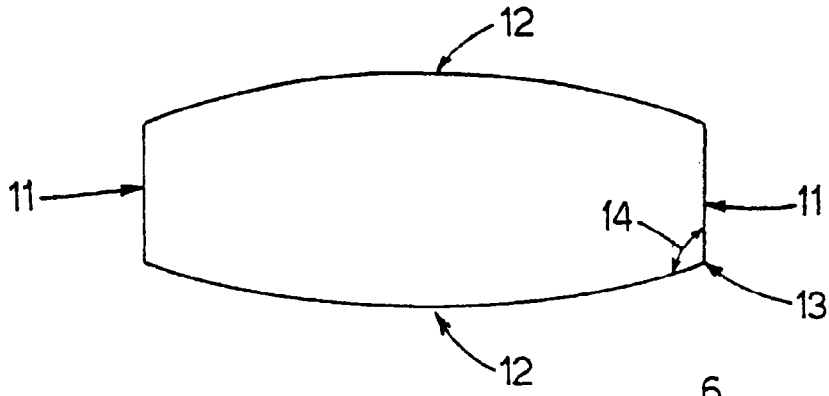
FIG. 10 shows a plan view of the FIG. 9 packet.
Figure 9:
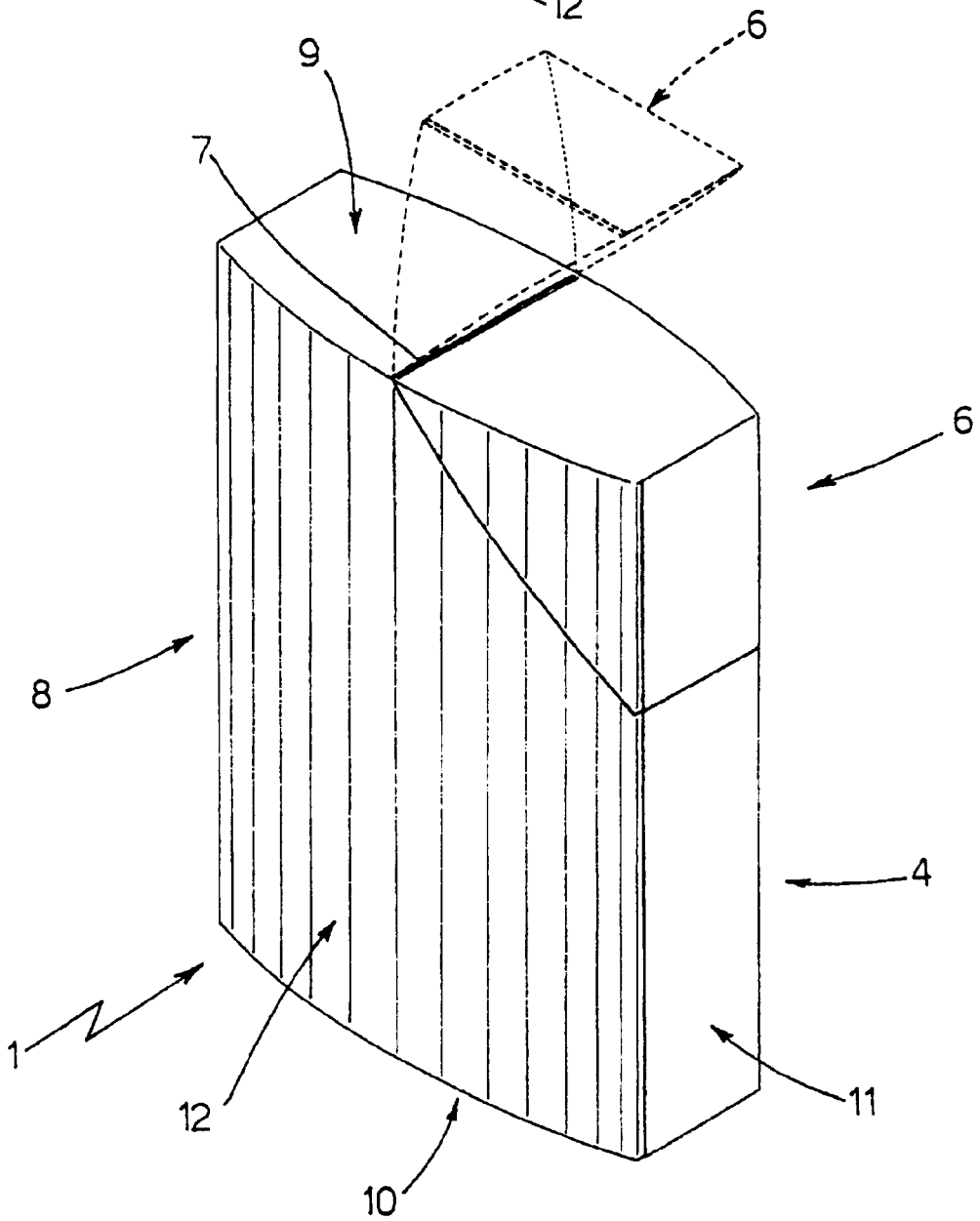
FIG. 9 shows a front view in perspective of a further embodiment of the packet according to the present invention.

In a further embodiment shown in FIGS. 9 and 10, each major lateral wall 12 has an outwardly convex profile curving continuously over the whole of major lateral wall 12. That is, as opposed to a flat central portion and two curved lateral bands, as in the FIG. 2, 5 and 7 embodiments, each major lateral wall 12 comprises one fully curved surface.

Figure 4:
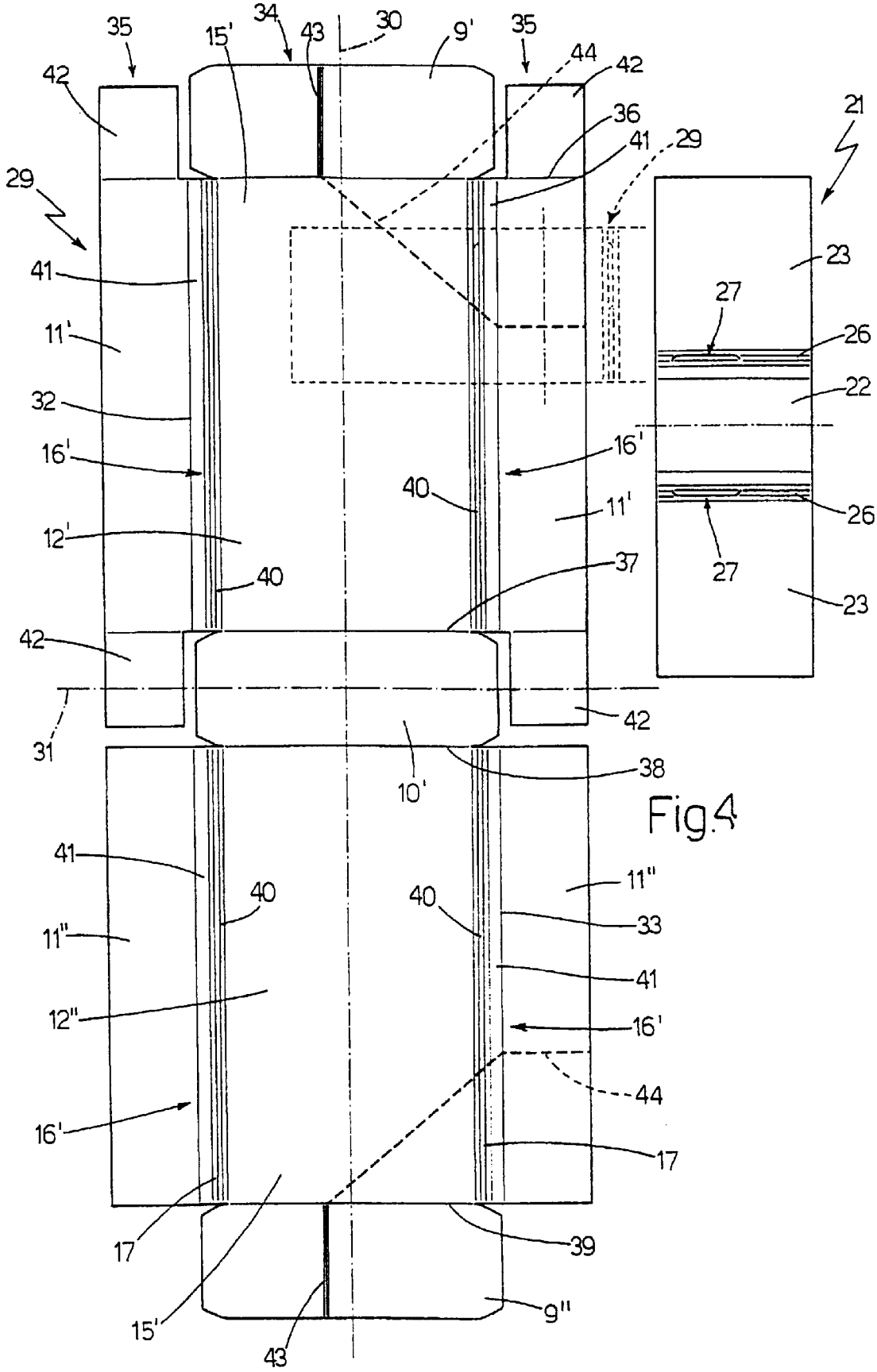
FIG. 4 shows a plan view of a blank and respective collar from which to form the FIG. 1 packet.

As shown in FIG. 4, the FIG. 1 and 2 packet 1 is formed from a corresponding flat blank 29, which is substantially in the form of an elongated rectangle, and the parts of which are indicated, wherever possible, using the same reference numbers, with superscripts, as for the corresponding parts of packet 1.

Blank 29 comprises a central longitudinal axis 30; a central transverse axis 31 (perpendicular to axis 30); and two preformed longitudinal bend lines 32 and 33, which divide blank 29 into a central longitudinal strip 34, and two lateral longitudinal strips 35. Strips 34 and 35 are crossed by a number of preformed transverse bend lines 36, 37, 38 and 39, which divide the central strip into a panel 9' extending between an outer edge of blank 29 and line 36; a panel 12' extending between lines 36 and 37; a panel 10' extending between lines 37 and 38; a panel 12" extending between lines 38 and 39 and identical with panel 12'; and a panel 9" extending between line 39 and an outer edge of blank 29 and identical with panel 9'.

Each panel 12', 12" comprises a flat central portion 15'; and two longitudinal lateral bands 16' located on either side of central portion 15', and each comprising an inner portion 40 (i.e. contacting central portion 15') preweakened by longitudinal weakening lines 17, and a smooth outer portion 41 extending along respective preformed bend line 32, 33.

Each panel 12', 12" has two longitudinal lateral wings 11', 11" located on respective longitudinal lateral strips 35 on either side of panel 12', 12", and separated from panel 12', 12" by respective longitudinal lines 32 and 33. Each wing 11' of panel 12' has two rectangular longitudinal appendixes 42 located at opposite ends of wing 11' and aligned longitudinally with each other; and appendixes 42 of the two wings 11' are aligned transversely in pairs on either side of panel 9' and panel 10'.

Each appendix 42 has a longitudinal dimension smaller (or, more generally speaking, no greater) than the minimum longitudinal dimension of the relative intermediate panel 9' or 10'and a transverse dimension smaller (or, more generally speaking, no greater) than the transverse dimension of respective lateral wing 11'.

During the formation of packet 1, panel 9' and panel 9" are superimposed and glued to define top end wall 9 of packet 1; each lateral wing 11' and corresponding lateral wing 11" are superimposed and glued to define a respective minor lateral wall 11 of packet 1; and each appendix 42 is folded squarely with respect to respective lateral wing 11', and is superimposed on and glued to an inner surface of respective panel 9' or 10' to define an inner portion of a respective end wall 9 or 10 of packet 1.

Each panel 9', 9" comprises a further preformed longitudinal bend line 43 defining, in use, hinge 7 of lid 6. To define end 5 separating bottom cup-shaped container 4 from top lid 6, blank 29 comprises two parting lines 44 (shown by the dash lines in FIG. 4); the two longitudinal preformed bend lines 43 and the two parting lines 44 are symmetrical with respect to the transverse axis 31 of blank 29, so that the two preformed longitudinal bend lines 43 are aligned longitudinally with each other.

In general, blank 29 is cut along parting lines 44, before packet 1 is formed, to separate bottom cup-shaped container 4 from top lid 6; or blank 29 is preweakened by partly cutting along parting lines 44, before packet 1 is formed, and top lid 6 is detached from bottom cup-shaped container 4 by the user when first opening packet 1.

As shown in FIG. 4, a first parting line 44 extends across panel 12' and a respective lateral wing 11' from one end of respective preformed bend line 43 up to an outer edge of lateral wing 11'; and a second parting line 44 extends across panel 12" and a respective lateral wing 11" from one end of respective preformed bend line 43 up to an outer edge of lateral wing 11". Each parting line 44 extends across respective panel 12', 12" in a direction sloping with respect to both longitudinal axis 30 and transverse axis 31, and extends across respective lateral wing 11', 11" in a direction perpendicular to longitudinal axis 30 and parallel to transverse axis 31.

FIG. 4 also shows collar 21 in the flattened configuration—shown by the continuous line—and in the final position with respect to blank 29—shown by the dash line. In general, collar 21 is folded, in use, into a U about group 2 of cigarettes 3, and is brought into contact with blank 29 when folding blank 29 about group 2.

One way of forming packet 1 from the flat blank 29 is described below.

Preferably, blank 29 is at least partly gummed in known manner when still flat; group 2 of cigarettes 3, already provided with collar 21 folded into a U, is then placed on an inner surface of blank 29 corresponding to panel 12'; appendixes 42 are folded squarely with respect to respective lateral wings 11', which are in turn folded squarely with respect to panel 12' onto group 2; panels 12', 12" and 10' are folded into a U about group 2; panels 9' and 9" are folded squarely one on top of the other to define top end wall 9; and, finally, wings 11" are folded squarely with respect to panel 12" onto wings 11' to complete packet 1.

Figure 5:
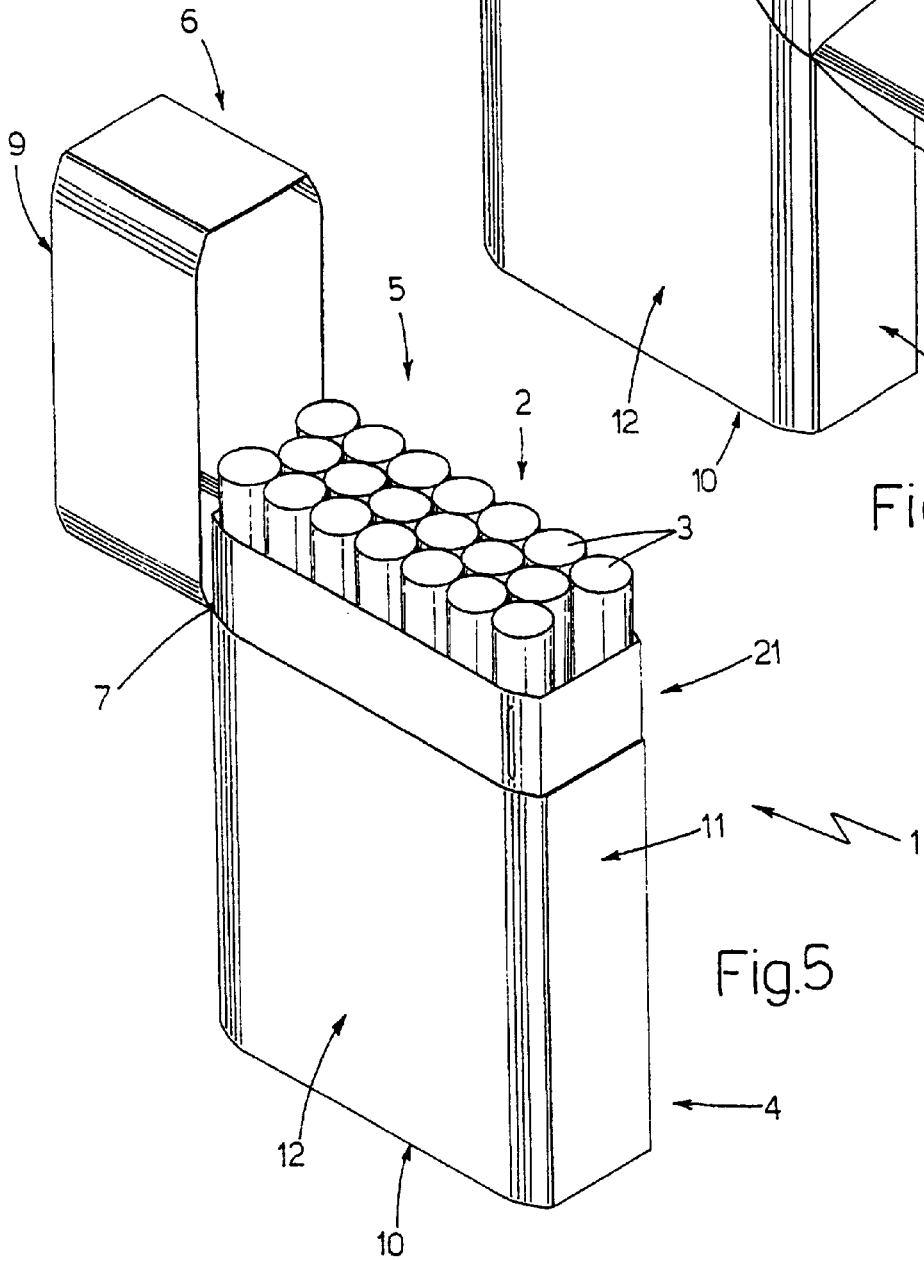
FIG. 5 shows a front view in perspective of a further embodiment of the packet according to the present invention in the open configuration.

In a further embodiment shown in FIG. 5, hinge 7 of lid 6 is located on a minor lateral wall 11 and is perpendicular to central portions 15 of major lateral walls 12 and parallel to minor lateral walls 11; and lid 6 affects the whole of a top portion of packet 1, and comprises the whole of top end wall 9, a top portion of one minor lateral wall 11, and two substantially rectangular portions of major lateral walls 12.

Figure 6:
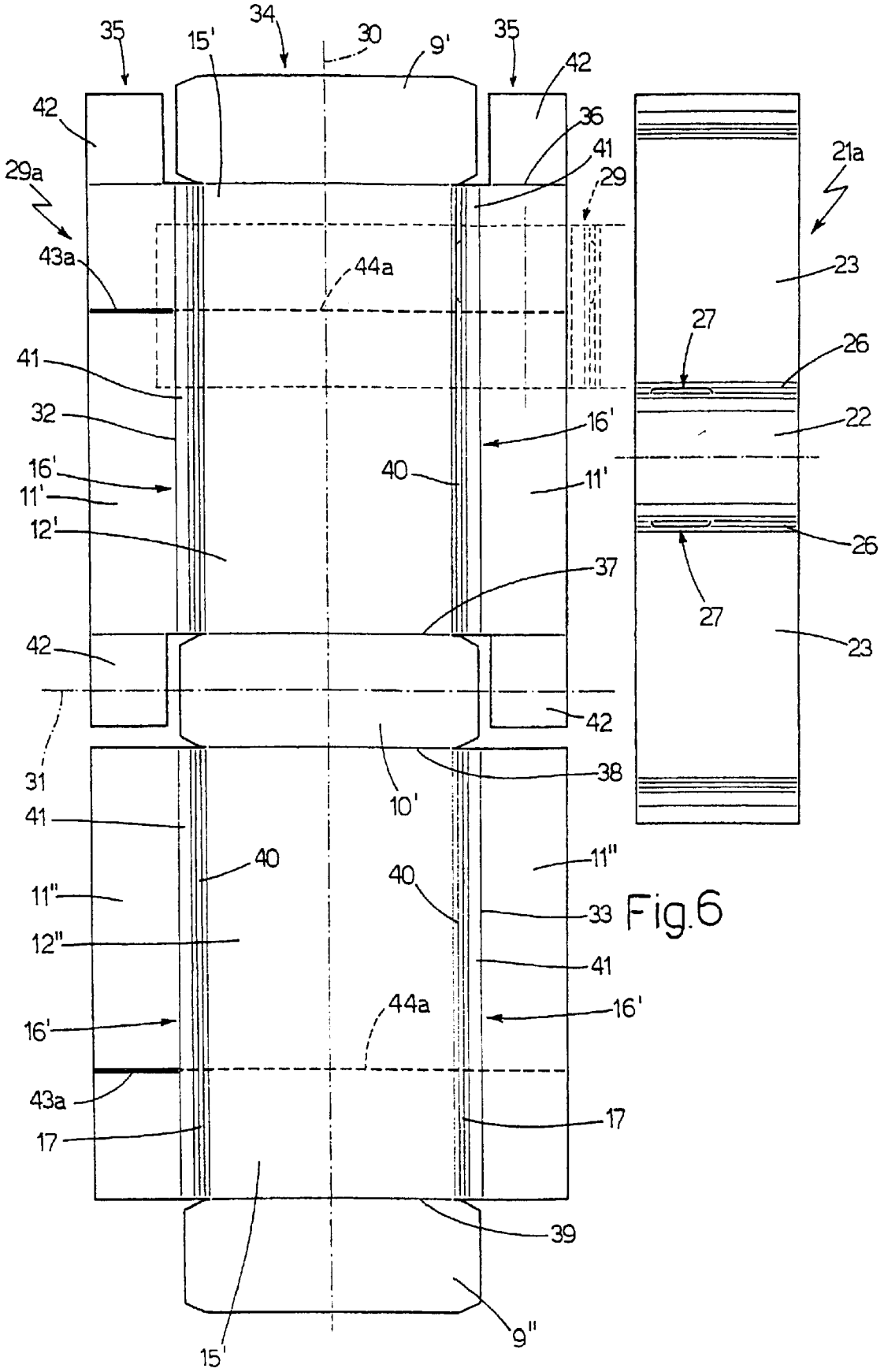
FIG. 6 shows a plan view of a blank and respective collar from which to form the FIG. 5 packet.

The FIG. 5 packet 1 is formed from the blank 29*a* and collar 21*a* in FIG. 6, which only differ from the FIG. 4 blank 29 and collar 21 described previously as regards the location and form of preformed bend lines 43 and parting lines 44, and the dimensions of collar 21*a*.

As shown in FIG. 6, one wing 11' and one wing 11" aligned longitudinally with each other each comprise a transverse preformed bend line 43*a* defining, in use, hinge 7 of lid 6; a first transverse parting line 44*a* extends across panel 12' and a respective wing 11' from one end of respective preformed bend line 43*a* up to an outer edge of lateral wing 11'; and a second transverse parting line 44*a* extends across panel 12" and a respective lateral wing 11" from one end of respective preformed bend line 43*a* up to an outer edge of lateral wing 11".

Figure 7:
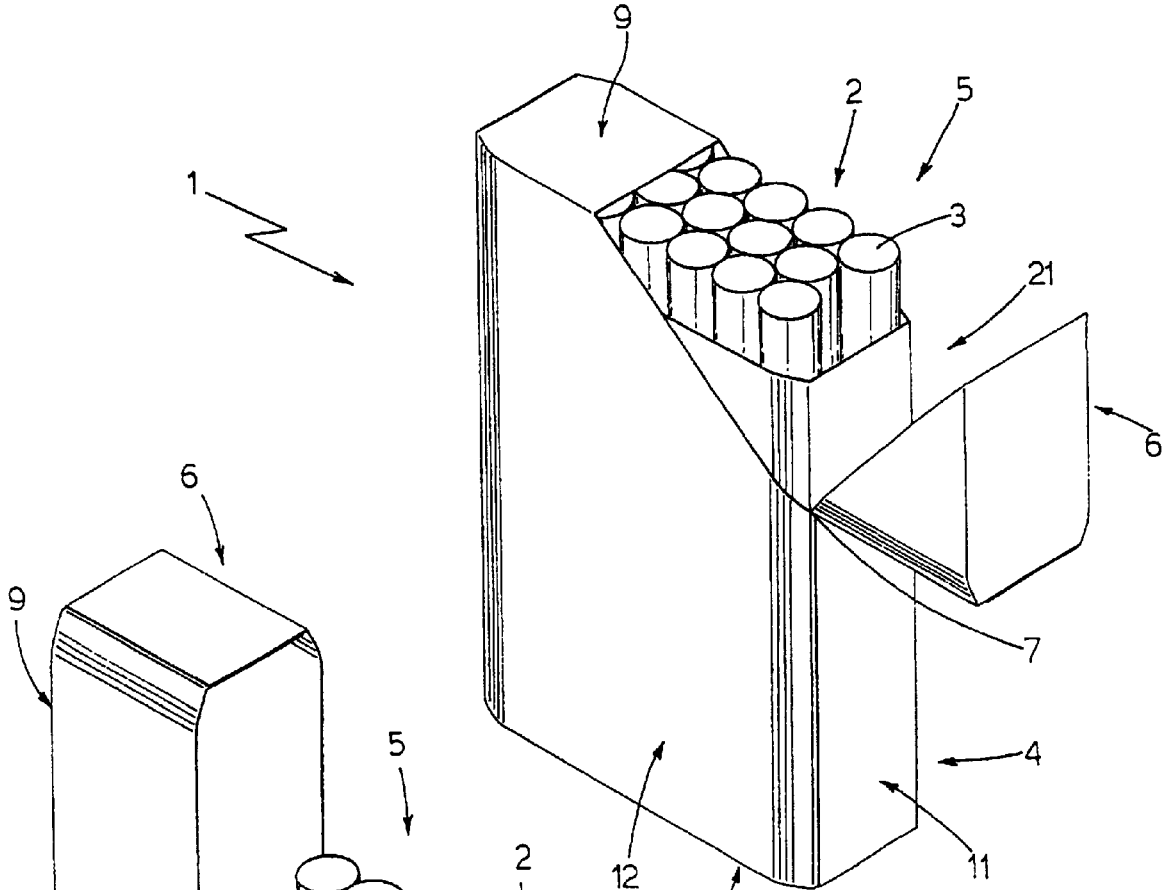
FIG. 7 shows a front view in perspective of a further embodiment of the packet according to the present invention in the open configuration.

In a further embodiment shown in FIG. 7, hinge 7 of lid 6 is located on a minor lateral wall 11 and is perpendicular to central portions 15 of major lateral walls 12 and parallel to minor lateral walls 11; and lid 6 affects a lateral portion of a top portion of packet 1, and comprises a portion of top end wall 9, a top portion of one minor lateral wall 11, and two substantially triangular portions of major lateral walls 12.

Figure 8:
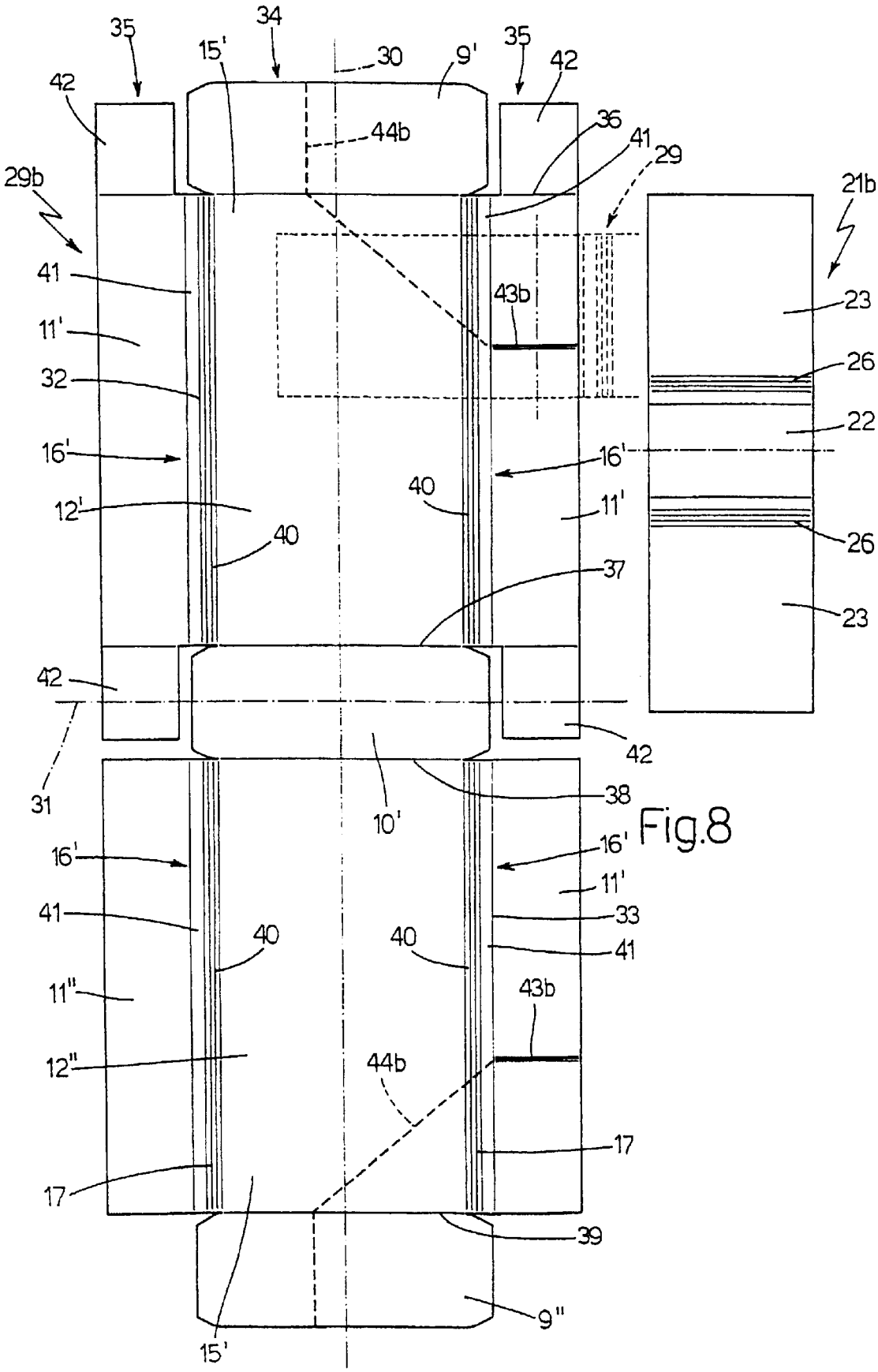
FIG. 8 shows a plan view of a blank and respective collar from which to form the FIG. 7 packet.

The FIG. 7 packet 1 is formed from the blank 29*b* and collar 21*b* in FIG. 8, which only differ from the FIG. 4 blank 29 and collar 21 described previously as regards the location and form of preformed bend lines 43 and parting lines 44, and the dimensions of collar 21*b*.

As shown in FIG. 8, one wing 11' and one wing 11" aligned longitudinally with each other each comprise a transverse preformed bend line 43*b* defining, in use, hinge 7 of lid 6; a first parting line 44*b* extends across panel 12' and along panel 9' from one end of respective preformed bend line 43*b* up to an outer edge of panel 9'; and a second parting line 44*b* extends across panel 12" and along panel 9" from one end of respective preformed bend line 43*b* up to an outer edge of panel 9". Each parting line 44*b* extends across respective panel 12, 12" in a direction sloping with respect to both longitudinal axis 30 and transverse axis 31, and extends along respective panel 9', 9" in a direction parallel to longitudinal axis 30 and perpendicular to transverse axis 31.

Hinge 7 of lid 6 is therefore located either on top end wall 9 (FIG. 2 and 9 embodiments) or on a minor lateral wall 11 (FIG. 5 and 7 embodiments), i.e. on flat walls. The fact that hinge 7 is located on a flat wall is particularly advantageous, by hinge 7 undergoing substantially no deformation when applying the transparent overwrapping, and being stronger as a whole, in that, unlike a curved wall formed from a flat cardboard blank, a flat wall is subject to substantially no internal stress.

What is claimed is:

1. A substantially parallelepiped-shaped, rigid hinged-lid cigarette packet comprising a lateral surface (8), and a flat top and bottom end wall (9, 10) facing and parallel to each other and defining said lateral surface (8); said lateral surface (8) comprising two facing minor lateral walls (11) and two facing major lateral walls (12); and the packet (1) comprising a bottom cup-shaped container (4), and a top lid (6) hinged to the cup-shaped container (4) by a hinge (7) substantially parallel to the minor lateral walls (11); at least one of said major or minor lateral walls (12, 11) has an outwardly convex profile and forms respective first obtuse dihedral angles (14) with the two adjacent lateral walls (11, 12); wherein said lateral wall (12, 11) having an outwardly convex profile comprises a respective central portion (15) and two lateral bands (16), which are preweakened by longitudinal weakening lines (17) and curving with the concavity facing inwards to connect the relative central portion (15) to the corresponding adjacent lateral walls (11, 12); each lateral band (16) forms with the relevant lateral wall (11, 12) a respective sharp edge (13), forms with the relevant lateral wall (11) a first respective obtuse dihedral angle (14), and forms with the relevant central portion (15) a second respective obtuse dihedral angle, which is greater than said first respective obtuse dihedral angle (14).

2. The packet of claim 1, wherein said hinge (7) is located on said top end wall (9).

3. The packet of claim 1, wherein said hinge (7) is located on a said minor lateral wall (11); said lid (6) comprising the whole of said top end wall (9).

4. The packet of claim 1, wherein said hinge (7) is located on a said minor lateral wall (11); said lid (6) comprising only a portion of said top end wall (9).

5. The packet of claim 1, wherein at least one of said two major lateral walls (12) has an outwardly convex profile and forms with the minor lateral walls (11) two respective sharp edges (13).

6. The packet of claim 1, wherein each of said two major lateral walls (12) has an outwardly convex profile and forms with the minor lateral walls (11) two respective sharp edges 13.

7. The packet of claim 1, wherein each of said end walls (9, 10) comprises two major lateral edges (18); each said major lateral edge (18) comprising respective curved lateral portions (20) of the same shape as each of said lateral bands (16) in cross section; said lateral portions (20) extending along respective axial ends of the respective lateral bands (16).

8. The packet of claim 1, wherein said bottom cup-shaped container (4) has an open top end (5); said packet (1) comprising a collar (21) connected to said container (4) and projecting partly from said open end (5) to engage an inner surface of said lid (6) when the lid (6) is in a closed position.

9. The packet of claim 1 and formed from a substantially rectangular flat blank (29), wherein said blank (29) comprises two longitudinal preformed bend lines (32, 33), and a number of transverse preformed bend lines (36, 37, 38, 39) defining, between said two longitudinal preformed bend lines (32, 33), a first intermediate panel (9'), a first front major panel (12') defining a relevant said major lateral wall (12), a second intermediate panel (10'), a second major panel (12") defining a relevant said major lateral wall (12), and a third intermediate panel (9"); each of said major panels (12', 12") having a smooth central portion (15'), and two lateral portions (16') preweakened by longitudinal weakening lines (17).

10. The packet of in claim 9, wherein each said major panel (12', 12") has two respective opposite longitudinal lateral wings (11', 11").

11. The packet of in claim 9, wherein the lateral wings (11') of the first major panel (12') have respective appendixes (42) located on opposite sides of a relative said intermediate panel (9', 10'); each said appendix (42) having a maximum longitudinal dimension no greater than the minimum longitudinal dimension of the relative said intermediate panel (9', 10'), and being superimposed on the relative intermediate panel (9', 10') to define a portion of a relative said end wall (9, 10) of the packet (1).

12. The packet of claim 11, wherein each said appendix (42) has a transverse dimension no greater than a transverse dimension of the respective said lateral wing (11').

13. The packet of claim 10, wherein said first and said third intermediate panel (9', 9") comprise respective further longitudinal preformed bend lines (43) aligned with each other and defining the hinge (7); said first major panel (12') and a respective said lateral wing (11') having a continuous first parting line (44) extending from one end of the respective further longitudinal preformed bend line (43) up to an outer edge of said lateral wing (11'); and a continuous second parting line (44) extending across said second major panel (12") and a respective said lateral wing (11"), and extending from one end of the respective further longitudinal preformed bend line (43) to an outer edge of said lateral wing (11").

14. The packet of claim 10, wherein one lateral wing (11') of the first major panel (12') and one lateral wing (11") of the second major panel (12") are aligned longitudinally with each other and comprise respective further transverse preformed bend lines (43); said first major panel (12') and the first intermediate panel (9') having a continuous first parting line (44) extending from one end of the respective further transverse preformed bend line (43) up to an outer edge of the first intermediate panel (9'); and a second continuous parting line (44) extending across said second major panel (12") and said third intermediate panel (9"), and extending from one end of the respective further transverse preformed bend line (43) up to an outer edge of the third intermediate panel (9").

* * * * *

UNITED STATES PATENT AND TRADEMARK OFFICE

CERTIFICATE OF CORRECTION

PATENT NO. : 6,715,605 B1
DATED : April 6, 2004
INVENTOR(S) : Manservigi et al.

It is certified that error appears in the above-identified patent and that said Letters Patent is hereby corrected as shown below:

Title page,
Item [57], ABSTRACT,
Line 2, "bas" should be -- has --

Column 7,
Lines 26 and 29, "of in claim" should be -- of claim --

Signed and Sealed this

Twentieth Day of July, 2004

JON W. DUDAS
*Acting Director of the United States Patent and Trademark Office*